US006286933B1

(12) United States Patent
Murakami et al.

(10) Patent No.: US 6,286,933 B1
(45) Date of Patent: Sep. 11, 2001

(54) INK JET HEAD

(75) Inventors: Shuichi Murakami, Kawasaki; Mineo Kaneko, Tokyo; Masayoshi Tachihara, Chofu; Michinari Mizutani; Takashi Inoue, both of Tokyo; Yuichiro Akama, Yokohama, all of (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 09/097,731

(22) Filed: Jun. 16, 1998

(30) Foreign Application Priority Data

Jun. 18, 1997 (JP) ..... 9-177604

(51) Int. Cl.[7] ..... B41J 2/14
(52) U.S. Cl. ..... 347/47; 347/45; 347/44
(58) Field of Search ..... 347/47, 44, 45, 347/28, 22

(56) References Cited

U.S. PATENT DOCUMENTS 4,994,825 * 2/1991 Saito et al. ..... 346/140 R
5,682,190 10/1997 Hirosawa et al. ..... 347/94
5,798,778 * 8/1998 Kimura et al. ..... 347/45
5,949,454 * 9/1999 Nozawa et al. ..... 347/45

FOREIGN PATENT DOCUMENTS 42 01 923 8/1992 (EP) .
0 631 869 1/1995 (EP) .
0 787 588 8/1997 (EP) .
0787588 A2 * 8/1997 (EP) ..... 347/47

* cited by examiner

*Primary Examiner*—John Barlow
*Assistant Examiner*—M Shah
(74) *Attorney, Agent, or Firm*—Fitzpatrick, Cella, Harper & Scinto

(57) ABSTRACT

An ink jet head is provided with an orifice plate having a plurality of discharge ports being open thereto. This ink jet head comprises evaporation suppressing groove in the vicinity of the discharge ports. With the arrangement thus formed, it becomes possible to heighten the humidity in the atmosphere in the vicinity of discharge ports, hence suppressing the evaporation from the discharge ports for the prevention of unstable discharges.

11 Claims, 9 Drawing Sheets

INK JET HEAD

BACKGROUND OF THE INVENTION

1. Field of the Invention

The present invention relates to an ink jet recording head that forms images on a medium by enabling ink or other liquid to fly onto the medium.

2. Related Background Art

For the ink jet recording, ink or other liquid is caused to fly onto a medium for the formation of images. More specifically, it is arranged to discharge liquid from the discharge ports of an ink jet head as shown in FIG. 10. FIG. 10 is a front view which shows the recording device substrate of a side shooting type ink jet head.

In FIG. 10, reference numeral 1 designates a plurality of ink discharge ports arranged on the recording substrate for discharging ink; and 2, an orifice plate. An ink supply opening 3 is open substantially in the center of the recording element substrate on which the discharge ports are arranged to supply ink to the discharge ports.

This opening is usually made by means of sandblasting, anisotropic etching, laser processing, or the like.

FIG. 11 is a cross-sectional view taken along line 11—11 in FIG. 10. In FIG. 11, reference numeral 5 designates an electrothermal converting element; and 6, a nozzle portion that retains ink to be discharged by means of bubbling caused by heat generated by the electrothermal converting element 5.

The discharge ports are usually in a state of being exposed to the outside air. As a result, liquid in the nozzles is evaporated from the discharge ports, thus causing the viscosity of liquid in the nozzle portion to rise. In some cases, the phenomenon may take place that hinders the regular discharges of ink droplets.

FIG. 12 is a view which shows this phenomenon conceptually. The portion in the interior of a discharge port, which is indicated by slanted lines in FIG. 12, represents the state where the evaporating component in ink has been evaporated.

Here, on the portion indicated by the slanted lines, the viscosity has risen due to the fact that the density of the non-volatile component of a solvent or the like becomes more densified mainly because water is evaporated. Also, the ratio of colorant, such as dyes contained in ink, has increased in ink. (Hereinafter, ink in such state is referred to as viscosity-increased ink.)

When ink becomes viscosity-increased, the volume of ink discharge is reduced, the shooting accuracy is lowered, and the disabled discharges may take place, among some other drawbacks. Particularly, if the temperature and/or humidity of the environment of outside air is low, this phenomenon becomes more conspicuous.

Also, the increasing of density of dyes in the nozzle portion tends to higher density of prints at the start of printing, causing the unevenness thereof. Also, it has been found that the longer the interval between the last and current discharges, the more the evaporation is advanced, presenting these drawbacks more conspicuously.

Therefore, as means conventionally adopted, ink is discharged onto the region other than the recording area before printing or in printing, (which is hereinafter referred to as predischarge). The execution of the predischarges prevents these drawbacks from taking place in operation, because the ink whose water content has been evaporated to make it viscosity-increased is discharged from the nozzle portion beforehand.

Here, however, the frequent predischarges result in the increased amount of ink consumption, leading to the higher running costs.

Also, it is required to increase the capacity of the waste ink absorbing member for storing predischarged ink in an ink jet printer, which necessitates to make the size of the printer larger with the inevitable increase of costs.

Also, fundamentally, the volume of the nozzle portion of the ink jet head currently in use should become smaller as it is required to print images in higher resolution by use of smaller liquid droplets. As a result, the ratio of viscosity-increased ink contained in ink to be discharged tends to become larger. Here, it is known that once such smaller droplets are exposed to the outside air, the discharges are subjected more easily to the instability than the larger liquid droplets used conventionally.

In accordance with the conventional examples described above, the evaporation makes rapid progress in the ink jet head that discharges smaller droplets. This phenomenon may bring about the deviation in the shooting accuracy, the reduction of discharge volume, and the disabled discharges as well in some cases.

Also, with the attention given to a single discharge port, the longer the interval between the last and current discharges, the more the evaporation is advanced to aggravate the problems described above.

SUMMARY OF THE INVENTION

With a view to solving the problems described above, the present invention is designed. It is an object of the invention to provide an ink jet head capable of preventing its unstable discharges by suppressing the evaporation from its discharge ports, and also, capable of minimizing the increase of running costs and others by making the time intervals as long as possible before any unstable discharges may take place. The ink jet head is also made capable of preventing the density from being densified more for the prints at the start of printing, which may result from evaporation from discharge ports.

In order to achieve the object described above, an ink jet head is structured as given below in accordance with the present invention.

In other words, an ink jet head, which is provided with an orifice plate having a plurality of discharge ports being open thereto, comprises evaporation suppressing grooves in the vicinity of the discharge ports.

For the ink jet head of the present invention, the interior of the evaporation suppressing grooves is made hydrophilic to the orifice plate thereof.

Also, for the ink jet head of the present invention, there are provided an orifice plate having a plurality of discharge ports open thereto, and a groove on the circumference of the array of the discharge ports. Then, evaporation suppressing grooves are formed in the vicinity of the discharge ports. For this ink jet head, the hydrophilicity of the surface of the evaporation suppressing grooves is higher than that of the orifice plate, and also, the hydrophilicity of the surface of the evaporation suppressing grooves is made higher still than that of the orifice plate, and then, the hydrophilicity of the surface of the evaporation suppressing grooves is higher than that of the aforesaid groove.

Also, for the ink jet head of the present invention, slope is provided on the end portion of the sectional configuration of each evaporation suppressing groove.

Also, for the ink jet head of the present invention, there are provided an orifice plate having a plurality of discharge ports open thereto, and a groove on the circumference of the array of the discharge ports. Then, evaporation suppressing grooves are formed in the vicinity of the discharge ports. For this ink jet head, the hydrophilicity of the surface of the evaporation suppressing grooves is made higher than that of the orifice plate. Here, the evaporation suppressing grooves are not connected with the aforesaid groove.

Also, for the ink jet head of the present invention, the water-repellency is relatively high on the orifice plate as the distance from the evaporation suppressing grooves becomes greater. In this case, the ratio of area covered by the water-repellent material on the orifice plate is made greater in order to heighten the water-repellency relatively as the distance from the evaporation suppressing grooves becomes larger on the orifice plate.

Also, for the ink jet head of the present invention, each end portion of the evaporation suppressing grooves, which is caused to abut upon first when operating the wiper, is formed at an acute angle, while the end portion thereof, which is then caused to abut upon later, is formed to be vertical or at an obtuse angle with respect to the end configurations of the evaporation suppressing grooves.

DETAILED DESCRIPTION OF THE PREFERRED EMBODIMENTS

With the arrangement provided with evaporation suppressing grooves in the vicinity of the discharge ports described above, the present invention makes it possible to heighten the humidity in the atmosphere near to the discharge port. In this manner, evaporation from the discharge ports is suppressed to prevent the unstable discharges.

The arrangement of the invention can make the time intervals longer before any unstable discharges may take place so that it is possible to prevent rise of the running costs or the like.

Also, with the arrangement of the present invention, it becomes possible to prevent the density from being densified more for the prints at the start of printing due to evaporation from the respective discharge ports.

Also, it is arranged that the farther away from the evaporation suppressing groove, the more the hydrophilic capability is intensified on the orifice plate. With this arrangement, ink can be collected into each of the evaporation suppressing grooves more easily. Further, the sectional configuration of each evaporation suppressing groove is configured in such a manner that the end portion thereof that touches first the wiper in its operation is arranged vertically, while the end portion of the evaporation suppressing groove that touches it later is sloped. With this arrangement, the amount of ink that may be scraped by the wiper is made effectively smaller.

EMBODIMENTS

Now, hereunder, the description will be made of the embodiments in accordance with the present invention.

Embodiment 1

Figure 1:
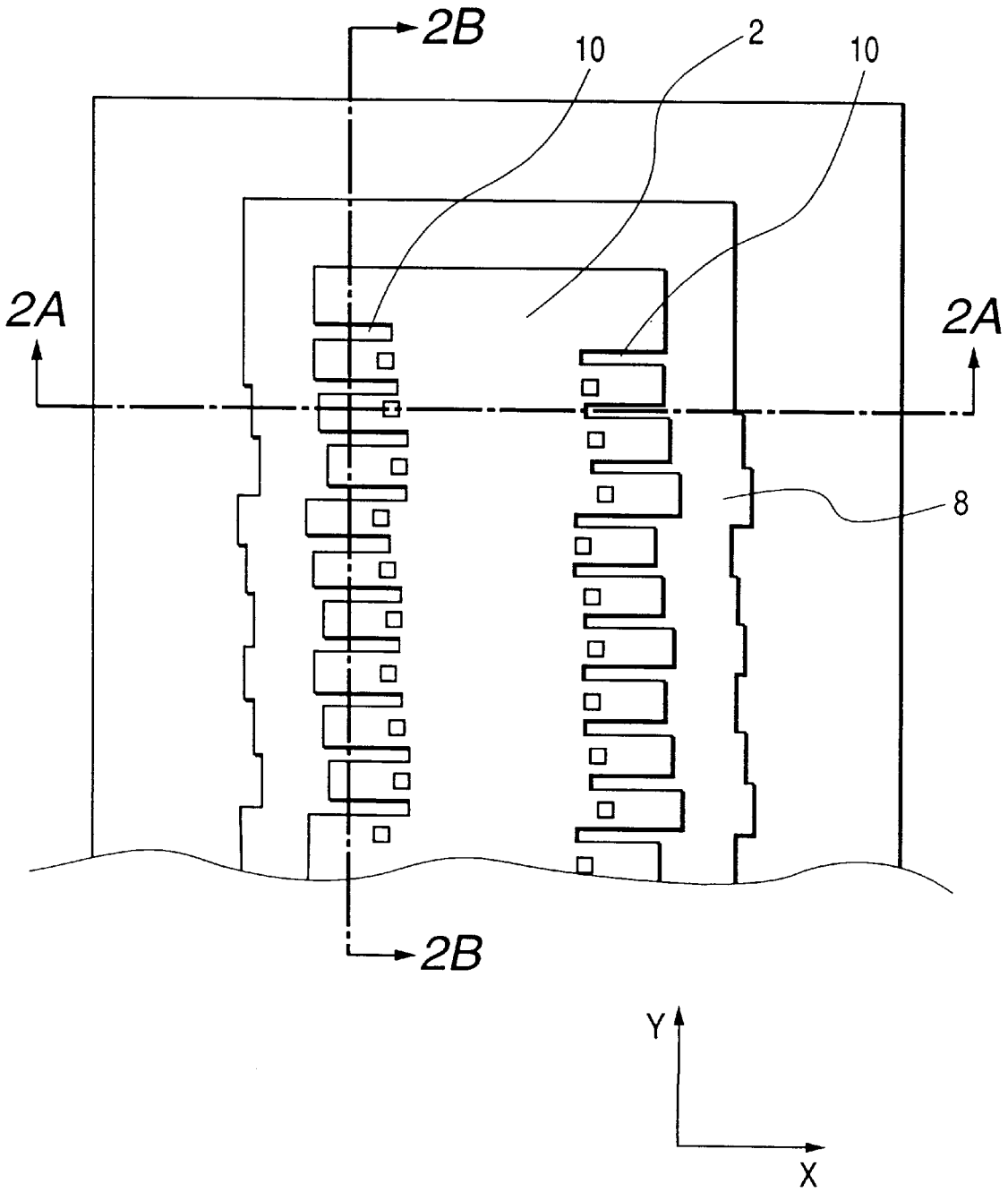
FIG. 1 is a front view which shows an ink jet head in accordance with a first embodiment of the present invention.

FIG. 1 is a front view which shows the arrangement of an ink jet head in accordance with a first embodiment of the present invention.

In FIG. 1, reference numeral 7 designates the elemental substrate where the electrothermal converting elements 5 are formed for discharging ink; 1, discharge ports comprising a plurality of openings arranged on the elemental substrate to discharge ink; 8, a plurality of grooves arranged on the circumference of the discharge ports; and 2, an orifice plate having the discharge ports formed therefor.

Figure 2A:
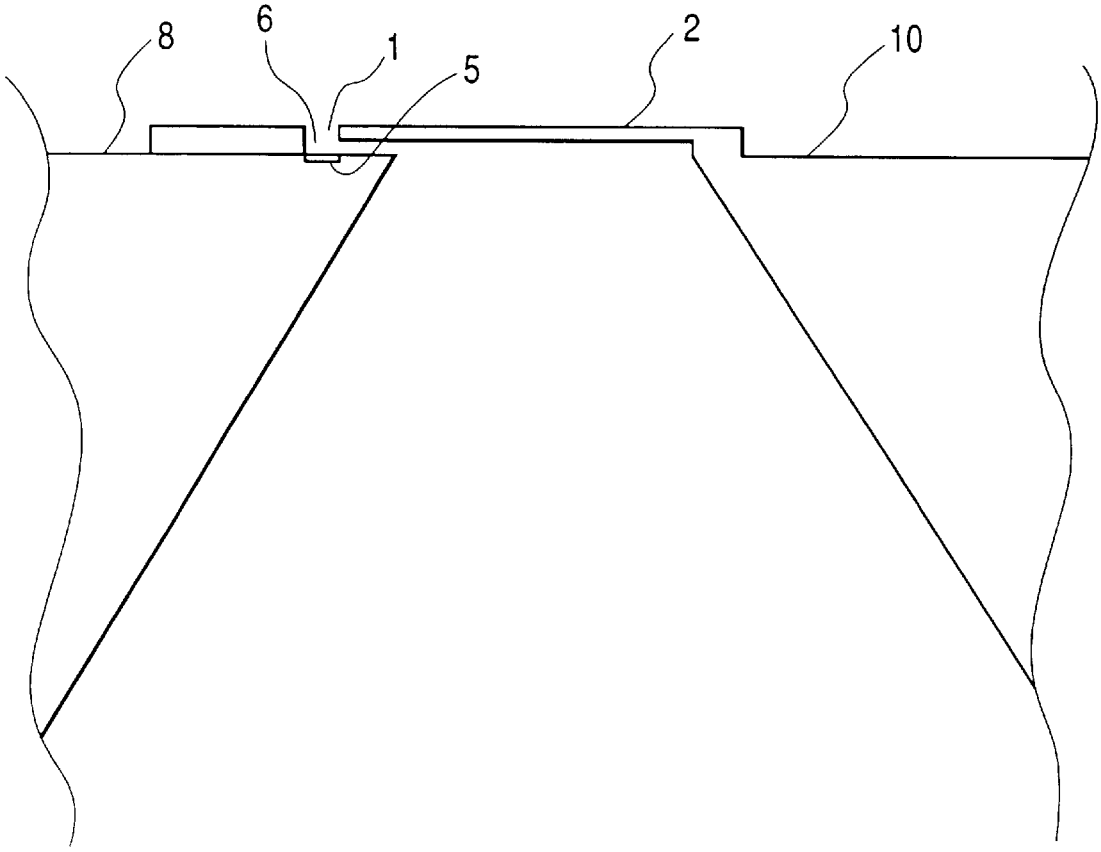
FIG. 2A is a cross-sectional view which shows the ink jet head in accordance with the first embodiment of the present invention, taken along line 2A—2A in FIG. 1.

Also, FIG. 2A is a cross-sectional view which shows the section taken along line 2A—2A in FIG. 1. In FIG. 2A, reference numeral 6 designates a nozzle. Here, the groove 8 is formed perpendicular to the orifice plate. When ink is stored in the evaporation suppressing grooves 10 connected with the grooves 8, it becomes possible to suppress the evaporation of ink from the discharge port 1 nearby.

Each width of the evaporation grooves is 20 $\mu$m, and each depth thereof is 3 $\mu$m. The distance from each of the discharge ports is approximately 20 $\mu$m.

Also, each of the evaporation suppressing grooves 10 is different in its length in accordance with the positional deviation of the discharge ports, respectively. In other words, the evaporation suppressing groove 10 is arranged in the middle between two discharge ports, but the evaporation suppressing groove is formed up to the end portion on the side which is farther away from the inner groove 8 of the two discharge ports.

Figure 2B:
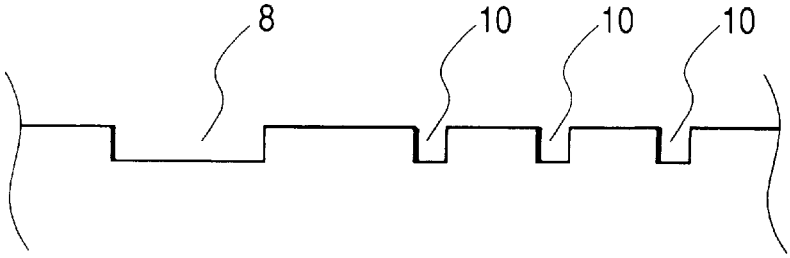
FIG. 2B is a cross-sectional view which shows the ink jet head in accordance with the first embodiment of the present invention, taken along line 2B—2B in FIG. 1.

Also, as shown in the sectional view in FIG. 2B, which is taken along line 2B—2B in FIG. 1, each of the evaporation suppressing grooves 10 is perpendicular to the elemental substrate in the direction y.

For the present embodiment, the resolution of the discharge ports is such as to necessitate the arrangement of 134 pieces at intervals of 300 DPI per side.

Also, the size of discharge port is 20×20 μm, and the gap between the groove 3 and each of the discharge ports is 100 μm.

As shown in FIG. 1, the positions of discharge ports are arranged to shift in the direction x in its arrays. In accordance with the present embodiment, the ink jet head discharges ink by bubbling of ink in the nozzles by the application of voltage to each of the electrothermal converting elements arranged on the elemental substrate.

The positions of the electrothermal converting elements should also be arranged to shift in the direction x in its arrays (because the positional relationship between the discharge ports and the devices are fixed). Otherwise, it is required to discharge ink at a time from all the discharge ports if linearity should be maintained along the vertical line formed by prints.

In order to perform such discharge, however, it is necessary to allow a greater amount of current to flow simultaneously. Here, a problem is encountered that it requires the provision of a larger source of electric supply for such printer.

Therefore, the positions of discharge ports are arranged to shift in the direction x in its arrays so that the timing should also be made shiftable for supplying pulses of electric current to the respective electrothermal converting elements. In this manner, the amount of electric current, which should be given at a time, is made smaller, while maintaining the linearity as needed.

Now, in the initial condition before printing, the evaporation suppressing grooves are in the state of no water being present in them. Here, the description will be made of the mechanism whereby to retain ink in the evaporation suppressing grooves 10.

When a printer is not used for printing for a long period of time, the orifice plate portion that includes the discharge ports is capped in order to suppress ink evaporation from the ink jet head. Then, before an actual printing, the predischarges are operated.

Figure 7:
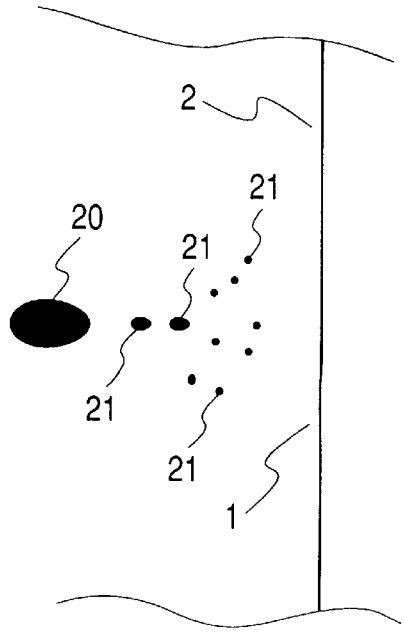
FIG. 7 is a view which shows the state of ink being discharged from an ink discharge port.

FIG. 7 is a view which illustrates ink being discharged from the discharge port. In FIG. 7, reference numeral 20 designates a main droplet. In this respect, the mist 21 (hereinafter referred to as self-mist, follower mist), which is formed by considerably smaller droplets than the main droplet, is discharged at the same time, in addition to the main droplets. The follower mist adheres to the surface of the orifice plate.

Figure 3:
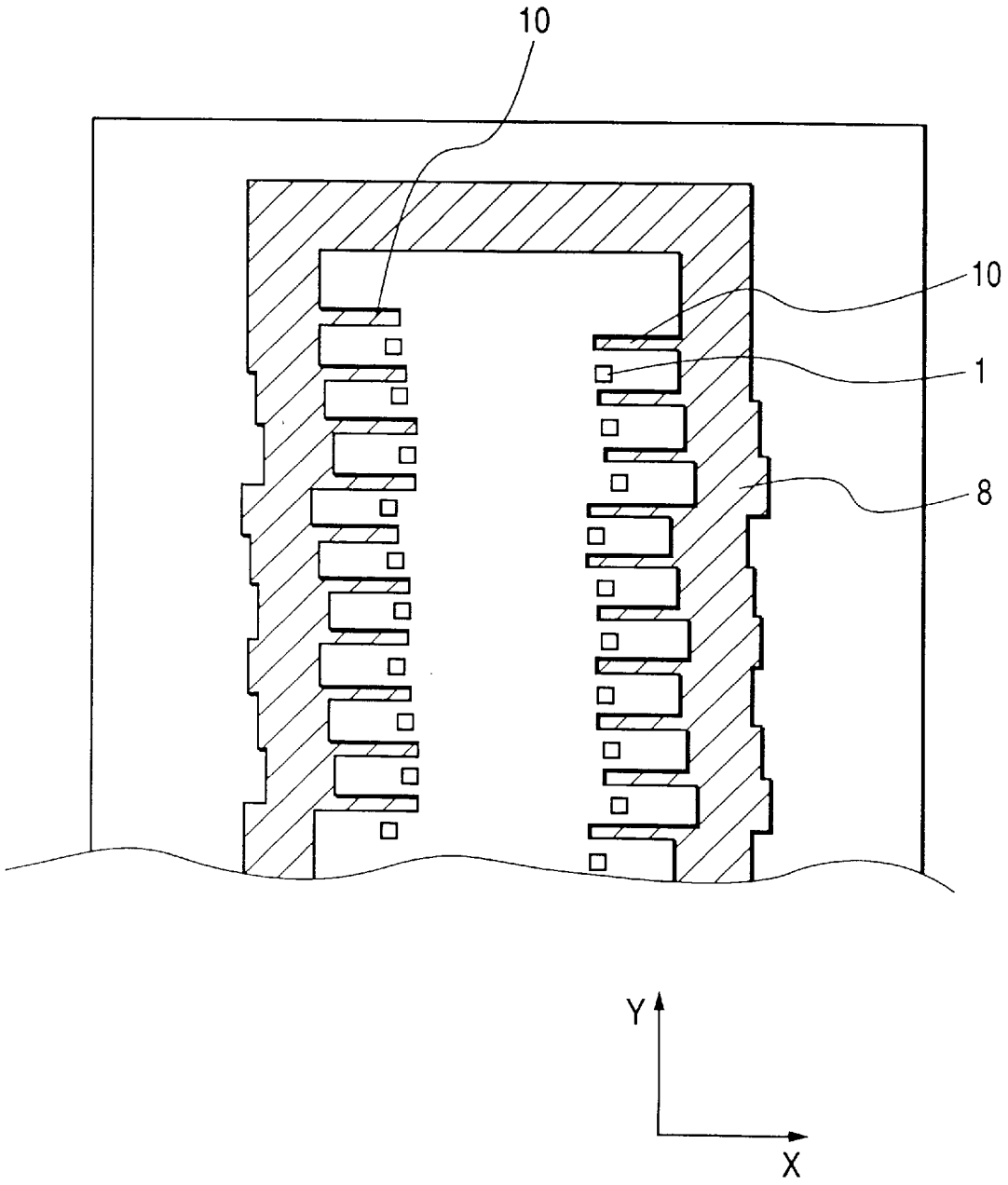
FIG. 3 is a view which shows the hydrophilic portion on the orifice plate in accordance with the first embodiment of the present invention.

In accordance with the present invention, it is important to comprise an arrangement in order to retain such follower mist in the evaporation suppressing grooves 10. Here, therefore, water-repellent agent is applied to the surface of the orifice plate 2 shown in FIG. 1 to make it water repellent. Then, the inner surface of each evaporation suppressing grooves 10 is made hydrophilic (as in the portion indicated by slanted lines in FIG. 3). With the arrangement, the follower mist adhering to the surface of the orifice plate is collected into each of the hydrophilic evaporation suppressing grooves 10 from the regions which are made water repellent.

Here, for the present invention, it is preferable to set each distance between the evaporation suppressing grooves 10 and the discharge ports 1 in 50 μm or less. More preferably, the distance should be set in 30 μm or less. In this manner, it becomes possible to secure the wettability on the circumference of the discharge ports. Further, the depth of the evaporation suppressing grooves should be set preferably in one μm or more. It should be set, more preferably, in three μm or more. With such depth, an appropriate amount of ink can be retained in each of the evaporation suppressing grooves 10 even if the surface of the orifice plate is wiped off for cleaning.

As described above, in accordance with the present invention, humidity of the atmosphere on the circumference of the discharge ports 1 rises due to water and alcoholic component evaporated from the ink which has been collected in the evaporation suppressing grooves 10. In this way, it is arranged to suppress the evaporation of ink from the discharge ports. Then, not only the density is prevented from being densified more at the starting position of printing, and discharges from becoming unstable, but also, the shooting deviation, and the disabled discharges are prevented from taking place.

In this respect, when printing is actually started, the follower mist created during printing, and also, the mist that may be bounced off from the recording medium can be collected into the evaporation suppressing grooves 10. Thus, printing is made executable more effectively, and at the same time, the time intervals between predischarges are made longer during printing (or the frequency thereof can be reduced).

Further, in accordance with the present embodiment, water-repellent agent is provided on the surface of the orifice plate 2 in order to make it water repellent, but the orifice plate 2 may be formed with water-repellent material itself or some other means may be adopted for providing water-repellency for the orifice plate.

Also, it is important that the water-repellency referred to in the description of the present embodiment has the water-repellent characteristics relatively more than the inner hydrophilic capability of each evaporation suppressing groove.

Also, in accordance with the present embodiment, the evaporation suppressing grooves 10 are hydrophilic.

Figure 4:
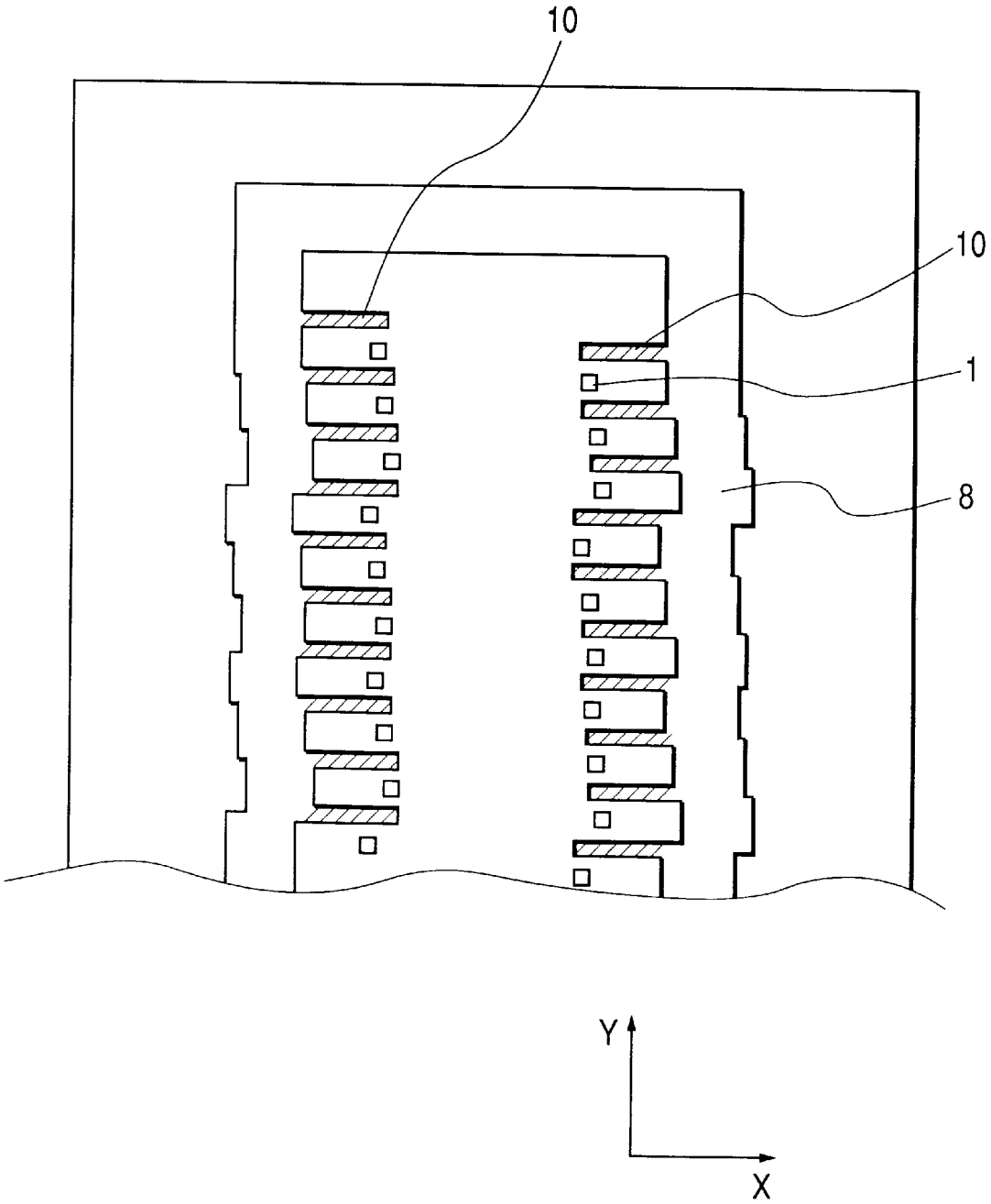
FIG. 4 is a view which shows the hydrophilic portion on the orifice plate in accordance with the first embodiment of the present invention.

In this respect, if the water-repellency is given to the groove 8 portion relatively more than the hydrophilic evaporation suppressing grooves, it becomes easier to collect even the ink that may be retained in the groove 8, which contributes to making the arrangement more effective (for the present embodiment, only the portion indicated by slanted lines in FIG. 4 is hydrophilic).

Figure 5A:
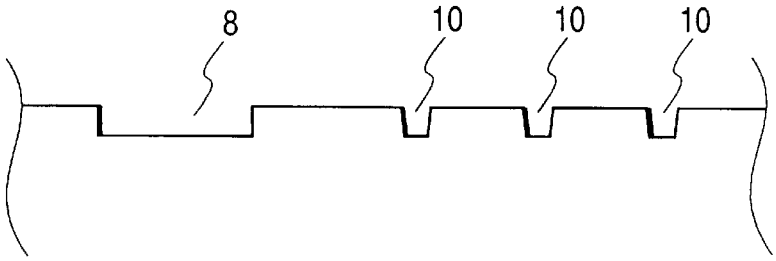
FIG. 5A is a cross-sectional view which shows the sloped configuration of the hydrophilic portion, taken along line 2B—2B in FIG. 1.
Figure 5B:
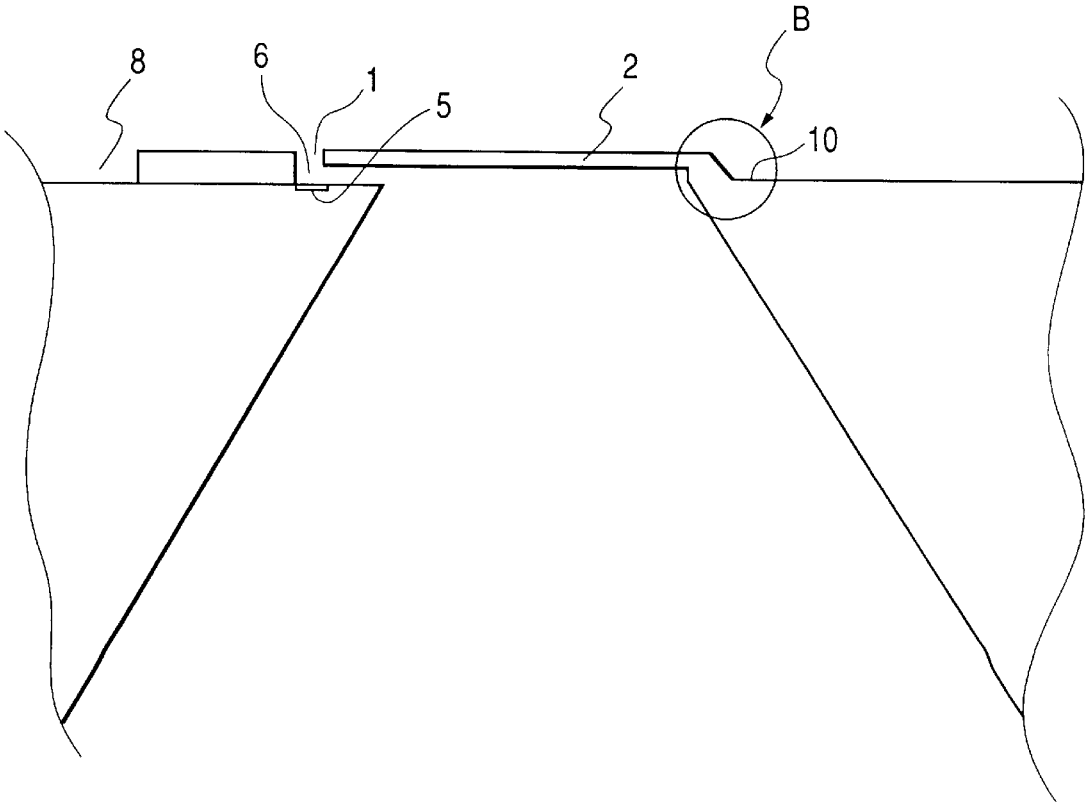
FIG. 5B is a cross-sectional view which shows the sloped configuration of the hydrophilic portion, taken along line 2A—2A in FIG. 1.

Further, for the embodiment described above, the sectional configuration of each evaporation suppressing groove is made vertical, but it becomes easier for such groove to collect ink from its circumferential area by sloping the groove in the direction x in FIG. 5A, which is the cross-section taken along line 2B—2B in FIG. 1 or in the direction y as shown in the area B in FIG. 5B, which is the cross-section taken along line 2A—2A in FIG. 1.

This is because, if the sectional configuration is vertical, the surface area of liquid droplets becomes increasingly larger when the liquid droplets, which are formed by the gathering mist, are collected into the grooves from the edges thereof. With the provision of slopes thus formed, the surface area of the increasing liquid droplets becomes smaller to facilitate their movement from the orifice plate to the grooves.

Here, in accordance with the present embodiment, the main objective is to collect the follower mist into the evaporation suppressing grooves 10. However, if the predischarge cap, which is prepared for predischarge droplets, is arranged close enough to the ink jet head, it is possible to collect the mist that may be bounced from the predischarge cap when the predischarges are performed.

Embodiment 2

Figure 6:
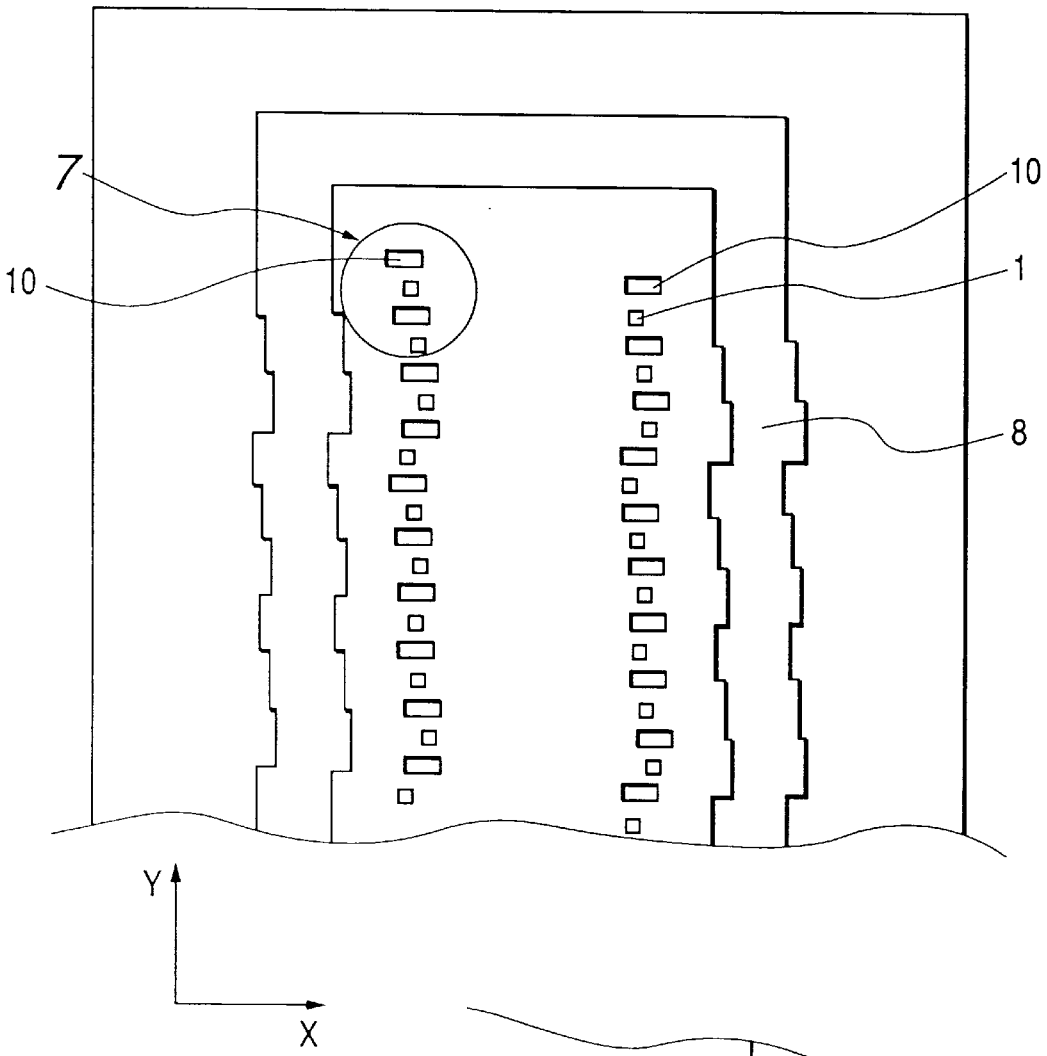
FIG. 6 is a front view which shows an ink jet head in accordance with a second embodiment of the present invention.

FIG. 6 is a front view which shows the arrangement of an ink jet recording head in accordance with a second embodiment of the present invention.

For the present embodiment, the resolution of the discharge ports 1 is such as to necessitate the arrangement of 150 pieces at intervals of 600 DPI per side.

Also, the size of the discharge port 1 is 12×12 μm. The gap between the groove 8 and each of the discharge ports 1 is 50 μm.

Unlike the first embodiment, the evaporation suppressing grooves 10 are arranged in the vicinity of each of the discharge ports, respectively, separated from the groove 8.

The size of each evaporation suppressing groove 10 is 10×25 μm. In accordance with the present embodiment, the evaporation suppressing grooves are provided particularly for the discharge ports near to each of them, respectively, for the purpose of enhancing the effect of suppression against the evaporation of ink.

The evaporation suppressing grooves 10 are in the condition of having no water in the initial state before printing. The mechanism to retain ink in the evaporation suppressing grooves 10 is the same as the one described in the first embodiment.

In accordance with the present embodiment, the arrangement is particularly arranged so as to make it easier to retain the follower mist in the evaporation suppressing grooves 10. Here, therefore, the surface of the orifice plate 2 shown in FIG. 6 is provided with water-repellency by gradation beginning from the evaporation suppressing grooves. In other words, the water-repellency is weaker nearer to the evaporation suppressing grooves. The water-repellency becomes more intensified as it is farther away from the evaporation suppressing grooves.

For the present embodiment, the orifice plate is formed by the water-repellent material on which patterning is executable. Then, the patterning on such water-repellent material is made rougher on the portion nearer to the evaporation suppressing grooves (the ratio of the water-repellant area is made smaller), while the ratio of the water-repellent area on the material is made larger as it is farther away from the grooves. Thus, the entire area thus arranged to be water-repellent. Also, the interior of each evaporation suppressing groove is made hydrophilic so as to increase the collecting amount of ink into each of the evaporation suppressing grooves 10 which are arranged nearer to the discharge ports. This demonstrates the enhanced effect in making the humidity higher in the atmosphere on the circumference of the discharge ports.

For the present embodiment, too, the water-repellency should be relative as referred to in the previous embodiment.

Embodiment 3

Figure 8:
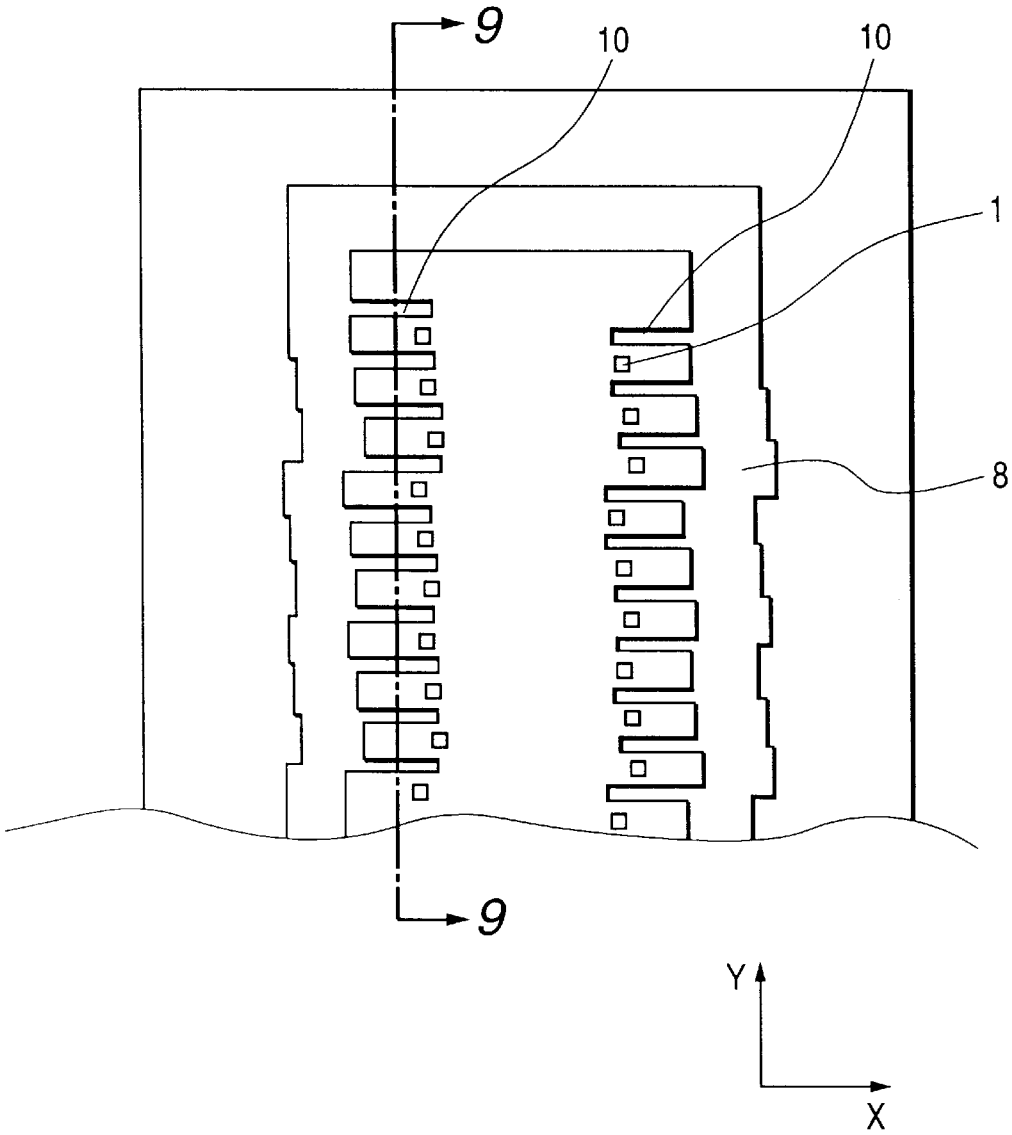
FIG. 8 is a front view which shows an ink jet head in accordance with a third embodiment of the present invention.

FIG. 8 is a front view which shows the arrangement of an ink jet recording head in accordance with a third embodiment of the present invention.

For the present embodiment, the resolution of the discharge ports is such as to necessitate the arrangement of 156 pieces at intervals of 300 DPI per side. Also, the size of the discharge port 1 is 20×20 μm. The gap between the groove 8 and each of the discharge ports 1 is 100 μm.

Ink is retained in each of the evaporation suppressing grooves 10 connected with the groove 8, thus preventing it from being evaporated from each of the discharge ports 1 nearby.

Each width of the evaporation suppressing grooves 10 is 25 μm. Each depth thereof is 3 μm. The distance from each of the discharge ports is approximately 20 μm.

Also, each length of the evaporation suppressing grooves 10 is different to arrange it be in accordance with the deviated position of each discharge port. In other words, each of the evaporation suppressing grooves 10 is arranged between two discharge ports 1. However, the evaporation suppressing groove 10 is formed up to the end portion of the discharge port 1 side of the two, which is farther away from the groove 8.

For the ink jet printing head, its wiping is operated after the predischarge when printing is in operation, thus wiping off the ink mist that has adhered to the orifice plate.

This operating is conducted for the purpose of preventing the shooting from being deviated because of the adhesion of ink mist to the edges of the discharge ports.

Figure 9:
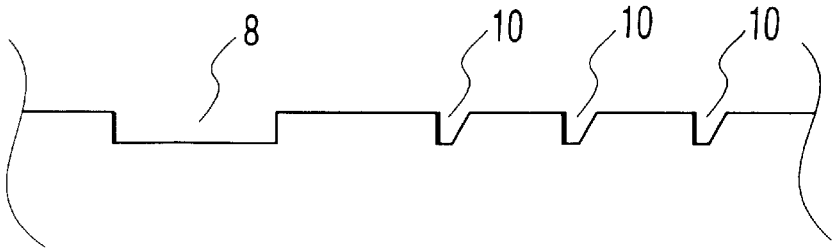
FIG. 9 is a view which shows the sloped configuration of the ink jet head in accordance with the third embodiment, taken along line 9—9 in FIG. 8.
Figure 10:
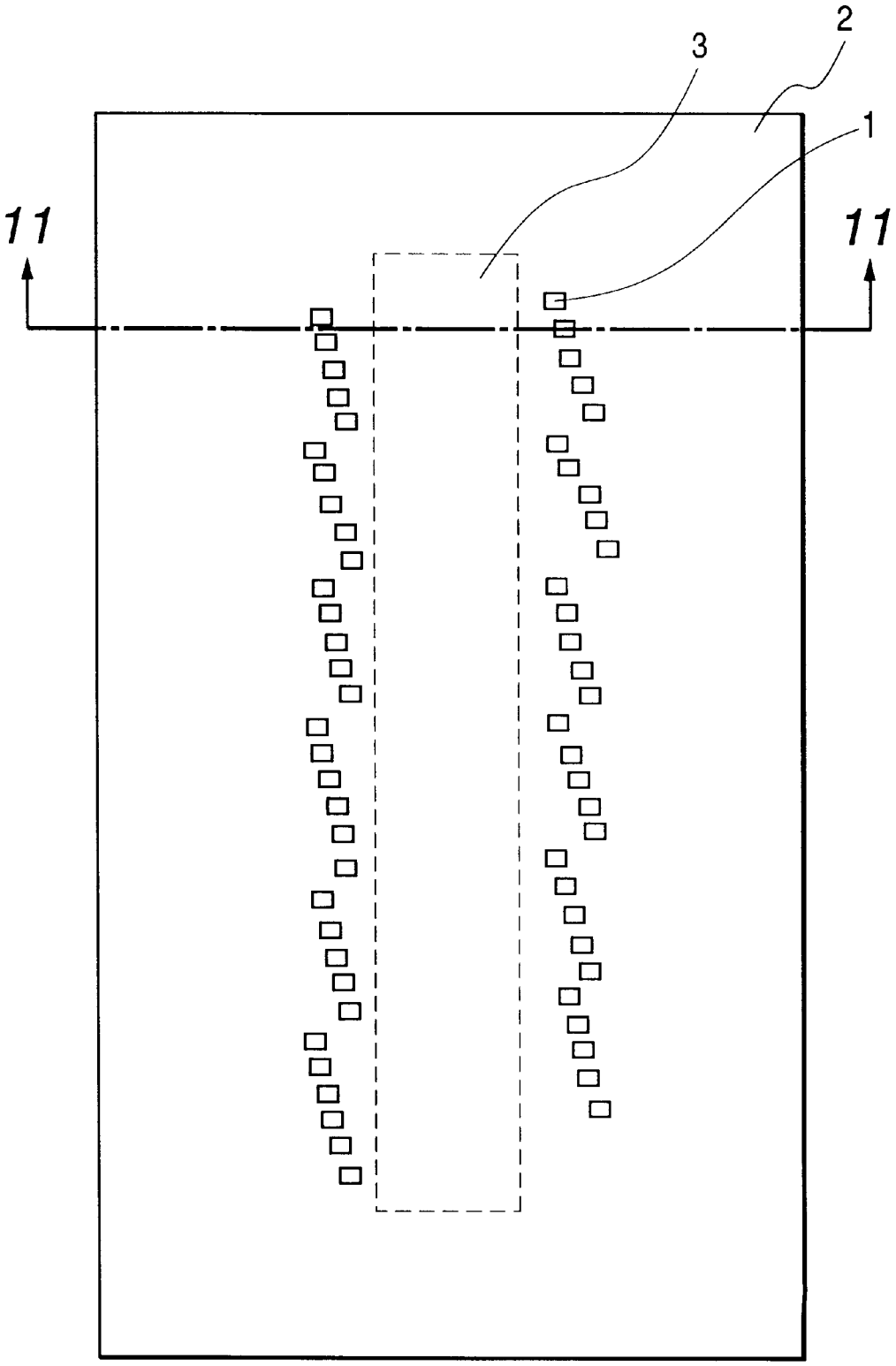
FIG. 10 is a front view which illustrates an ink jet head in accordance with the conventional example.
Figure 11:
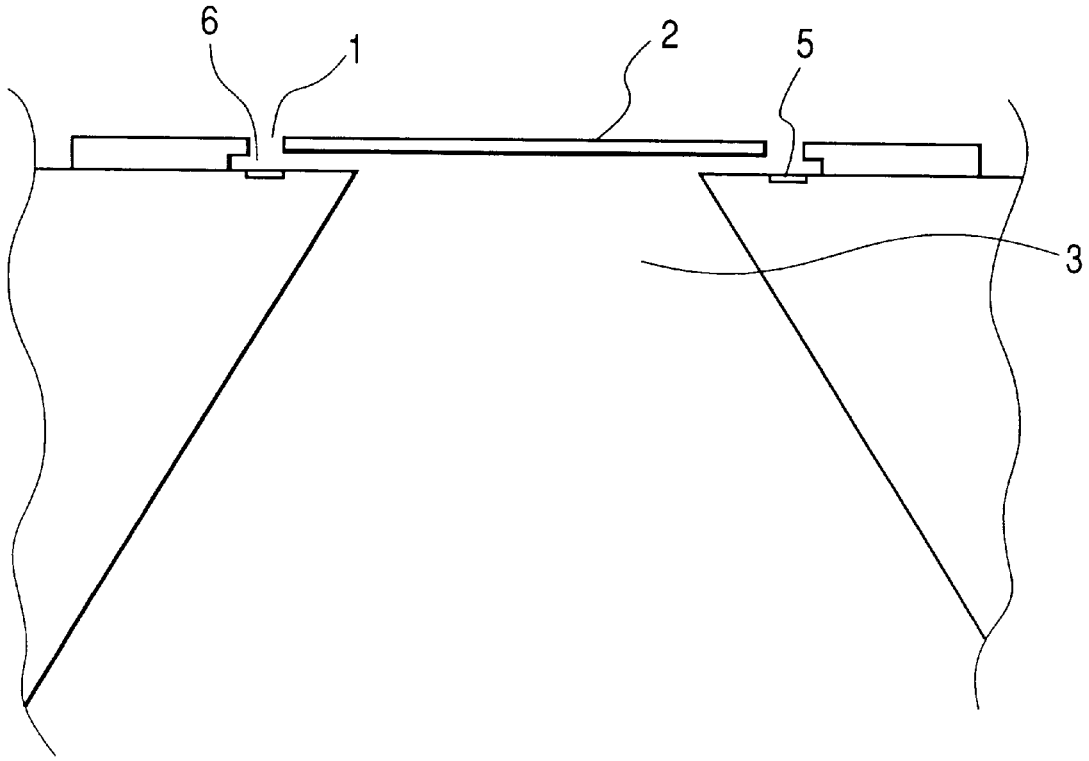
FIG. 11 is a cross-sectional view which illustrates the conventional example, taken along line 11—11 in FIG. 10.
Figure 12:
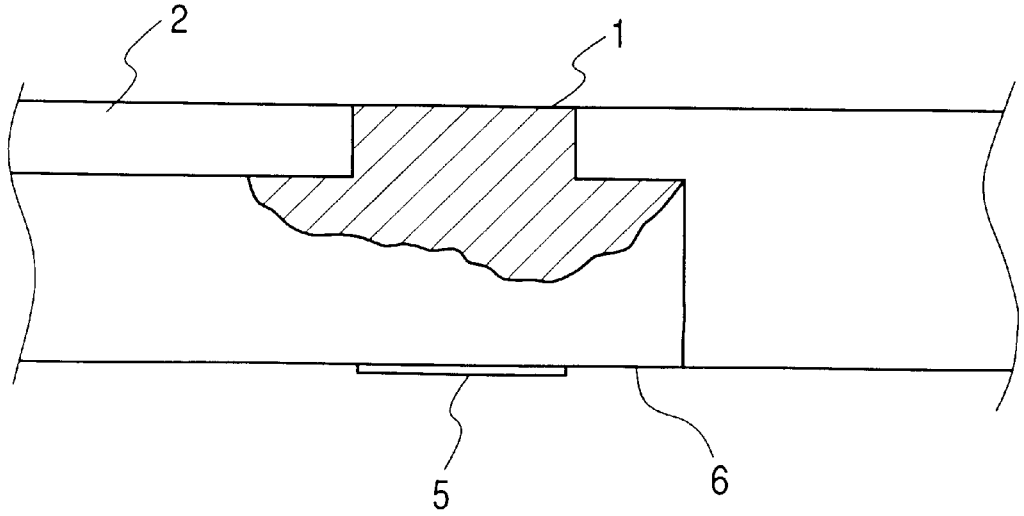
FIG. 12 is a conceptual view which illustrates the ink evaporation from the ink discharge port in accordance with the conventional example.

However, in some cases, ink may be scraped by the wiper from the evaporation suppressing grooves 10. Here, therefore, in accordance with the present embodiment, the sectional configuration of the evaporation suppressing groove shown in FIG. 8, which is taken along line 9—9 in it, is arranged to be as shown in FIG. 9. In other words, when the wiper operation is conducted in the direction y, the end portion of the evaporation suppressing groove that abuts upon the wiper first is configured to be vertical, while slope is given to the end portion of the evaporation suppressing groove 10 that abuts upon it later.

In this manner, the amount of ink that may be scraped by the wiper decreases, hence securing the amount of ink that should be retained in each of the evaporation suppressing grooves 10. Furthermore, it is made easier to collect ink mist from the surrounding area thereof.

As described above, in accordance with the present invention, there provided evaporation suppressing grooves in the vicinity of discharge ports, respectively. The humidity in the atmosphere on the circumference of the discharge ports is made higher. In this way, the evaporation from the discharge ports is suppressed to prevent discharges from becoming unstable.

Also, in accordance with the present invention, it becomes possible not only to make the time intervals of unstable discharge longer before any unstable discharges, and then, to minimize the increase of running costs or the like, but also, to prevent the density from becoming densified more when printing is started due to evaporation from the discharge ports. Also, the water-repellency on the orifice plate is made more intensified as it is farther away from the evaporation suppressing grooves. This arrangement contributes to facilitating the collection of ink into the evaporation suppressing grooves. Further, sectional configuration of each evaporation suppressing groove is formed in such a manner that the end portion thereof that touches the wiper first when the wiping operation is conducted is made vertical, while the end portion that touches it later is sloped, hence making it possible to reduce the amount of ink that may be scraped by the wiper, hence materializing a more effective ink jet head.

What is claimed is:

1. An ink jet head provided with an orifice plate having a plurality of discharge ports being open thereto and arranged in an array, comprising:

evaporation suppressing grooves in the vicinity of said discharge ports arranged such that between any two adjacent ones of said evaporation suppressing grooves, one of said discharge ports is disposed and is within 30 μm of each of those two adjacent evaporation suppressing grooves.

2. An ink jet head according to claim 1, wherein the interior of each of said evaporation suppressing grooves is hydrophilic against said orifice plate.

3. An ink jet head according to claim 1, wherein a groove is provided outside said evaporation suppressing grooves on the circumference of said array of said discharge ports.

4. An ink jet head according to claim 1, wherein the hydrophilic capability of said evaporation suppressing grooves is higher than that of said groove on the circumference of said array of said discharge ports.

5. An ink jet head according to claim 1, wherein slope is provided for an end wall portion of the sectional configuration of each of said evaporation suppressing grooves, such that the end wall portion is not perpendicular to said orifice plate.

6. An ink jet head according to claim 1, wherein said evaporation suppressing grooves are not connected with said groove on the circumference of said array of said discharge ports.

7. An ink jet head according to claim 1, wherein water-repellency provided to said orifice plate increases as the distance on said orifice plate from said evaporation suppressing grooves increases.

8. An ink jet head according to claim 1, wherein a ratio of area covered by a water-repellent material on said orifice plate is increased in order to increase water-repellency relatively as the distance on said orifice plate form said evaporation suppressing grooves increases.

9. An ink jet head according to claim 1, wherein an end wall portion of each of said evaporation suppressing grooves caused to be abutted upon first by a wiper operation is formed at an acute angle, while an end wall portion thereof caused to be abutted upon later by the wiper operation is formed to be vertical or at an obtuse angle with respect to the end configuration of said respective evaporation suppressing groove.

10. An ink jet head according to claim 1, wherein a depth of each of said evaporation suppressing grooves is one $\mu$m or more.

11. An ink jet head according to claim 1, wherein a depth of each of said evaporation suppressing grooves is three $\mu$m or more.

* * * * *

UNITED STATES PATENT AND TRADEMARK OFFICE

CERTIFICATE OF CORRECTION

PATENT NO. : 6,286,933 B1
DATED : September 11, 2001
INVENTOR(S) : Shuichi Murakami et al.

It is certified that error appears in the above-identified patent and that said Letters Patent is hereby corrected as shown below:

Column 5,
Line 53, "grooves" should read -- groove --.

Column 6,
Line 36, close up right margin; and
Line 37, close up left margin.

Column 7,
Line 40, "water-repellant" should read -- water-repellent --; and
Line 43, "area" should read -- area is --.

Column 8,
Line 34, "there" should read -- there are --.

Column 10,
Line 8, "form" should read -- from --.

Signed and Sealed this

Sixteenth Day of April, 2002

*Attest:*

*Attesting Officer*

JAMES E. ROGAN
*Director of the United States Patent and Trademark Office*